US005183110A

United States Patent [19]

Logan et al.

[11] Patent Number: 5,183,110

[45] Date of Patent: Feb. 2, 1993

[54] GRAVEL WELL ASSEMBLY

[75] Inventors: James D. Logan, Bargersville; Jeffrey R. Bastin, Fountain Town, both of Ind.

[73] Assignee: Bastin-Logan Water Services, Inc., Franklin, Ind.

[21] Appl. No.: 773,124

[22] Filed: Oct. 8, 1991

[51] Int. Cl.[5] ..... E21B 43/04; E21B 43/08; E21B 43/10

[52] U.S. Cl. ..... 166/278; 166/51

[58] Field of Search ..... 166/51, 278, 276, 205

[56] References Cited

U.S. PATENT DOCUMENTS

| | | | |
|---|---|---|---|
| 53,767 | 4/1866 | Alvord . | |
| 1,619,521 | 3/1927 | Lawlor et al. . | |
| 2,266,000 | 12/1941 | Charles . | |
| 2,356,769 | 8/1944 | Layne . | |
| 2,604,168 | 7/1952 | Van Ackeren | 166/51 |
| 2,652,117 | 9/1953 | Arendt et al. | 166/51 X |
| 3,482,627 | 12/1969 | Nebolsine . | |
| 3,583,487 | 6/1971 | Block | 166/278 |
| 3,670,817 | 6/1972 | Saucier . | |
| 3,978,033 | 4/1972 | Pitcher et al. . | |
| 4,071,087 | 1/1978 | Ingerle et al. . | |
| 4,192,375 | 3/1980 | Maly et al. | 166/51 |
| 4,199,272 | 4/1980 | Lacey | 166/51 X |
| 4,474,239 | 10/1984 | Colomb et al. | 166/278 |
| 4,526,230 | 7/1985 | Kojicic . | |
| 4,583,594 | 4/1986 | Kojicic . | |
| 4,635,725 | 1/1987 | Burroughs | 166/51 X |
| 5,058,676 | 10/1991 | Fitzpatrick et al. | 166/278 |

OTHER PUBLICATIONS

"SEAWELL—You can't pump where there isn't air!", Gordon L. Newby, Inc., Bakersfield, Calif., pp. 1–4, date unknown.

"Aquastream TM—Suction Flow Control Device", Western Company, Mission Woods, Kans., pp. 1–4, Apr. 1988.

"Pre-Pak TM PVC Dual Wall Well Screen", Diversified Well Products, Inc., National Drillers Buyers Guide, p. 25, Sep. 1988.

*Primary Examiner*—Ramon S. Britts
*Assistant Examiner*—Frank S. Tsay
*Attorney, Agent, or Firm*—Barnes & Thornburg

[57] ABSTRACT

An assembly for pumping groundwater from a bore of a well includes a pump having a pump inlet positioned in the bore of the well and a screen having a plurality of apertures and positioned to surround the pump inlet. A gravel pack is inserted between the screen and native groundwater bearing formations. The gravel pack can be removed and replaced by inserting a removable slide tube down the bore of the well to hold back infall of rock or gravel debris. After replacement of the gravel pack, the slide tube is removed.

10 Claims, 4 Drawing Sheets

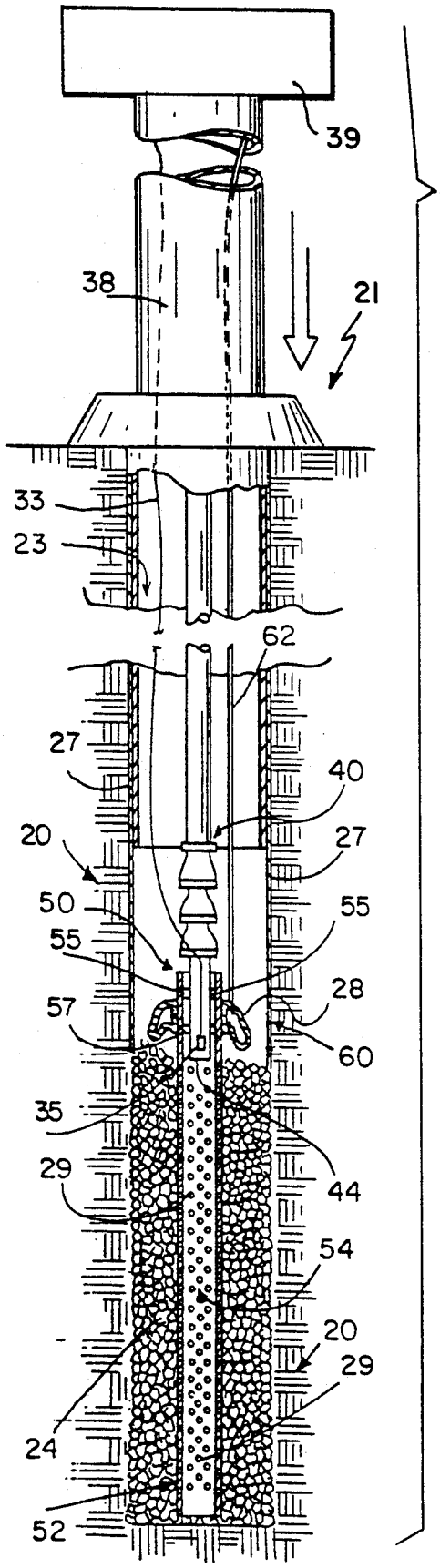
FIG. 2
FIG. 3
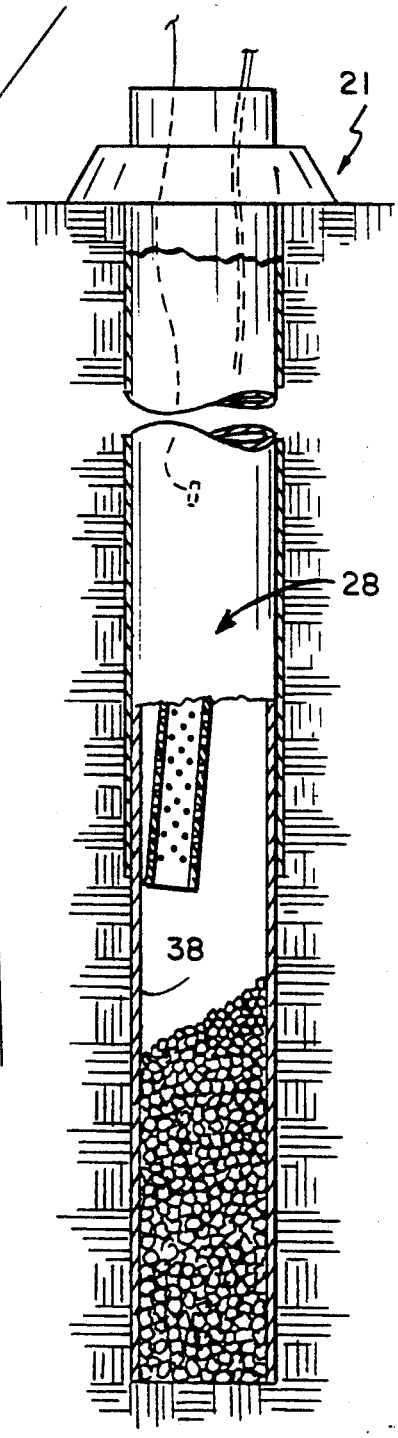

GRAVEL WELL ASSEMBLY

BACKGROUND AND SUMMARY OF THE INVENTION

This invention relates to well pump assemblies for pumping groundwater. More particularly, this invention relates to well screens, strainers, and filters for use in water wells.

Deteriorating well performance commonly results from failure of screening surrounding a pump inlet positioned in a bore of a well. Screen failure can often be attributed to blockage of the screen by chemical incrustation, biofouling, or physical blockage by silt, sand or gravel. Alternatively, failure can result from corrosion of the screen (either mechanical or chemical) which decreases well performance by widening the screen pores enough to allow passage of sand through the screen. The resultant influx of sand particles into the pump can greatly reduce pump life and efficiency.

One method of increasing the usable lifetime of screens involves centralizing the screen in the bore of the well and packing gravel around the screen. The gravel, commonly known as a "gravel pack", acts as a prefilter that traps sand particles before they can clog or corrode the screen. One example of such a gravel pack is discussed in U.S. Pat. No. 1,619,521 to Lawlor et al., issued Mar. 1, 1927. Another design for a well screen is found in U.S. Pat. No. 2,266,000 to Charles, issued Dec. 16, 1941. Both of these screen designs (or "strainers" as they are often called in the literature) utilize gravel as a supplementary screening medium that retards the passage of sand toward the pump inlet.

However, gravel packs are not an ideal solution to the problem of screen clogging or corrosion. Although clogging or chemical incrustation of the gravel pack takes longer than clogging or incrustation of the screen, eventually the gravel pack will become clogged with particles, or biologic or chemical incrustations. Even replacement of a clogged gravel pack is not a completely satisfactory solution because the changes in velocity flow caused by the transition between the gravel pack and the native rock and gravel formations tends to induce chemical precipitation in the native formations surrounding the gravel pack. Eventually this chemical precipitation (or particle or biologic clogging) will block pores in the native formation, diminishing its permeability to groundwater flow. Even if the gravel pack is replaced, the well performance can be permanently reduced by blockage of the pores in those regions of the native formations surrounding the gravel pack.

The present invention encompasses an assembly for pumping groundwater from native formations that includes pumping means for pumping groundwater. The pumping means has an inlet positioned in a bore of a well for intake of water contained in groundwater bearing native formations and screening means for screening the inlet to prevent intake of particles greater than a predetermined size. A gravel pack is positioned in the bore of the well to surround the screening means and filter groundwater flowing toward the pump inlet, collecting particles (such as sand and silt) and chemical deposits precipitated within the gravel pack by changes in flow velocity of groundwater. Means for barring collapse of native formations into the bore of the well following removal of the gravel pack, the screening means, and the inlet from the bore of the well are also provided.

In preferred embodiments, means for barring collapse of native formations into the bore of the well includes a slide tube dimensioned to fit within the bore of the well between the native formations and the gravel pack. When it is necessary to remove the gravel pack for replacement with fresh gravel, the slide tube is inserted down the bore of the well to hold back collapse of native formation material into the bore of the well as the gravel pack is removed. Following replacement of the gravel pack, the slide tube is withdrawn from the bore of the well.

In another embodiment, means for barring collapse of native formations into the bore of the well include a porous casing permanently positioned in the bore of the well in contact with native formations. The porous casing is configured to have a plurality of pores therethrough, with pore sizes dimensioned to present substantially no impedance to flow velocity of groundwater moving through the porous casing toward the pump inlet. In this embodiment of the invention, groundwater flowing toward the pump inlet moves without substantial velocity changes from native formations, through the porous casing, and into a gravel pack positioned between the screening means and the porous casing.

The present invention also provides an assembly for pumping groundwater from native rock and gravel formations. The pump assembly has a pump and a pump inlet positioned in the bore of the well. The pump inlet is surrounded by a screen configured to have a plurality of apertures therethrough. The apertures are sized to prevent intake into the pump inlet sand-sized or larger of particles The porous casing has a plurality of pores with pore sizes substantially greater than the aperture size of the screen. In addition, the pores of the porous casing are dimensioned to present substantially no impedance to flow velocity of groundwater moving through the porous casing toward the pump inlet. Groundwater flowing toward the pump inlet easily moves without substantial changes in flow velocity through the porous casing and into a gravel pack positioned between the screen and the porous casing.

The gravel pack contains gravel having a gravel size greater than the aperture size of the screen. The integral pores extending through the gravel pack are selected to present pore diameters substantially corresponding to the pore diameters of gravel or rock in native formations. Because of the matched pore sizes of the gravel pack and the native formations, the flow velocity of groundwater does not substantially change as groundwater flows from the native formations into the gravel pack. Deposition of chemical precipitants and particles is promoted in the gravel pack, not in the surrounding native formations, since the velocity of groundwater flow changes only within the gravel pack near the screen (which has much smaller apertures sized to prevent influx of gravel and sand from the pack into the pump inlet).

When well groundwater production begins to decrease, it is only necessary to withdraw and replace the "used" gravel pack and its associated contaminants with a fresh gravel pack to bring the well back to normal production level. Because of this design, little or no deposition of particles or chemical incrustations occur in the native formations surrounding the bore, since during operation of the well there was no substantial reduction in the velocity of groundwater flow in the native formations that trigger such depositions of contaminants.

In other preferred embodiments, an impervious casing is positioned in the bore of the well to extend downward to meet the porous casing. Sealing means are provided to seal the bore between the pump inlet and the impervious casing. The sealing means prevents fluid communication between portions of the bore above the sealing means and portions of the bore below the sealing means. The sealing means includes an annular member formed from gas impermeable elastic material that can be inflated with gas to expand the annular member about the tube and form a seal between the tube and the impervious casing. Deflation of the annular member by gas release serves to break the seal. To aid in determining the extent of the clogging of the gravel pack, it is possible to position a pressure sensor below the annular member to measure changes in fluid pressure. Significant decreases in fluid pressure signal the need to replace the gravel pack.

Additional features and advantages of the invention will become apparent to those skilled in the art on consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 2 is a sectional view of the bore of the well illustrated in FIG. 1, with the pump temporarily disconnected and removed, and the inflatable annular seal deflated, allowing driving insertion of a slide tube downward into the bore of the well;

FIG. 3 is a sectional view of the slide tube shown in FIG. 2, fully inserted into the bore of the well to hold back infall of native formations during removal and replacement of the gravel pack;

DETAILED DESCRIPTION OF THE DRAWINGS

Conventional small aperture well screen filters are positioned in a well in direct contact with rock, sand, or gravel of native formations. Groundwater passing through such native formations toward a conventional well screen in response to pumping action of a pump can be impeded by deposits of chemically precipitated minerals, or sand that collects around the well screen during passage of mineral laden groundwater through the well.

Active pumping of groundwater through a conventional well screen provided with small apertures results in velocity induced pressure changes in the groundwater, disturbing its chemical equilibrium. Chemical species normally at equilibrium in slow moving groundwater become insoluble and precipitate from quickly moving groundwater, forming deposits in the native formations surrounding the screen. These deposits typically are carbonates (e.g. calcium carbonate or magnesium carbonate), sulfates (e.g. calcium sulfate or magnesium sulfate), iron hydroxides, hydrated iron oxides, hydrated magnesium oxides, or magnesium hydroxides. These chemically precipitated materials in turn act to trap sand particles, stones, silts, gravel, or other particulate debris moving through the native formation. Over time, these deposits greatly decrease the permeability of the native formations and can partially or completely clog a conventional well screen, causing a substantial unwanted reduction in groundwater pumping capacity.

Figure 1:
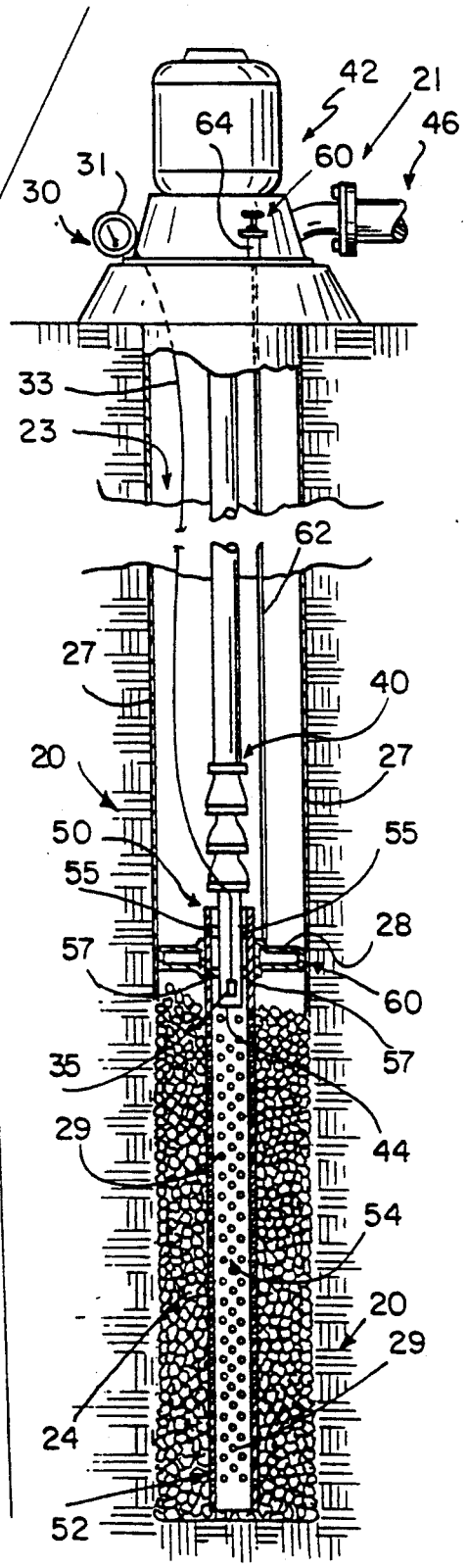
FIG. 1 is a sectional view of a bore of a well, illustrating a water pump at the surface, an impervious casing at the top of the bore, a gravel pack located below the impervious casing and in contact with groundwater bearing formation, and an inlet pipe connected to the water pump and extending downward into the bore, the inlet pipe being surrounded by an inflatable annular seal to reduce oxygen levels in the gravel pack.
Figure 4:
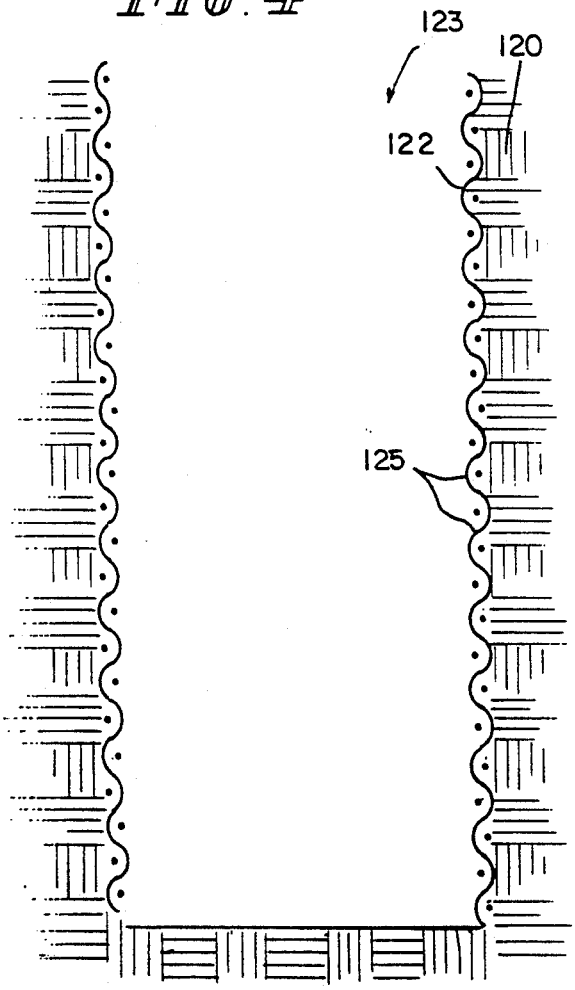
FIG. 4 is a sectional view of a bore of a well fitted with a porous casing at the bottom of the well bore, the porous casing acting to reduce infall of material from the native formation into the bore; while permitting unimpeded groundwater flow.
Figure 5:
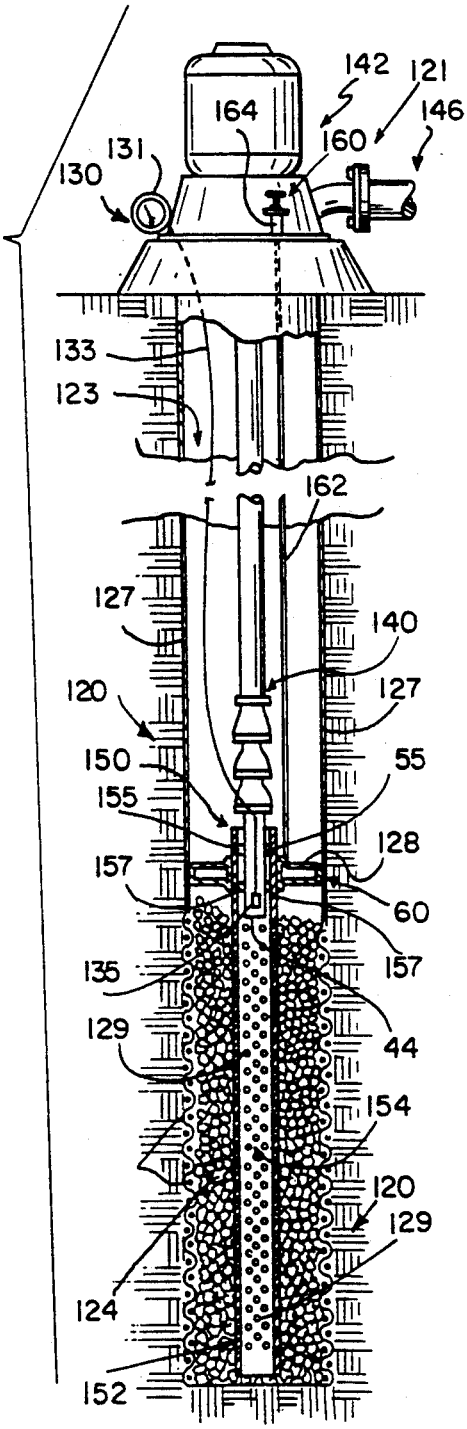
FIG. 5 is a sectional view of the pump, pump inlet, and a gravel pack positioned inside the porous casing in the bore of the well illustrated in FIG. 4.
Figure 6:
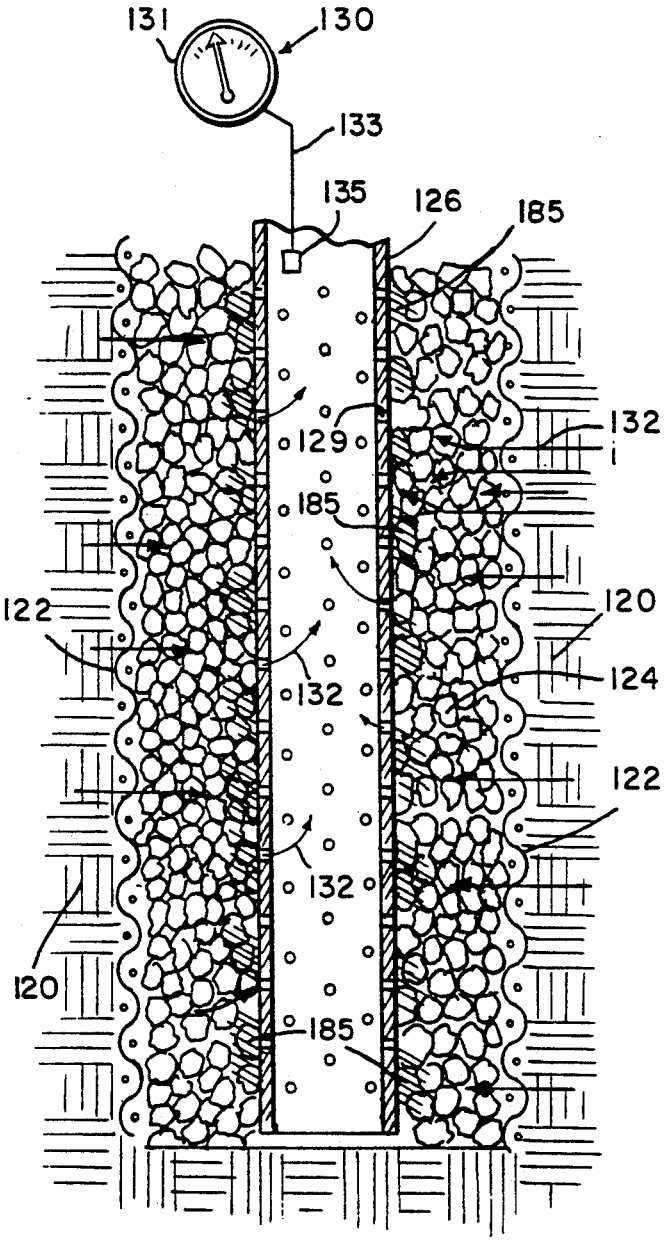
FIG. 6 is an enlarged view of the bottom region of the well bore and pump assembly shown in FIG. 5, with arrows 132 added to indicate direction of groundwater flow from the gravel pack into the pump assembly.

Gravel pack/well pump assemblies such as shown, for example, in FIGS. 1-3 or in FIGS. 4-6, are an improvement over conventional gravel pack/well pump assemblies, in part, because they are easier to regenerate and/or replace. These gravel pack/well pump assemblies are configured to promote deposition into their respective gravel packs of mineral precipitates from the groundwater. Since a gravel pack can be easily removed, cleaned, and replaced, it is preferable to promote deposition in the gravel pack rather than allow uncontrolled deposition in native formation adjacent to the gravel pack.

Further control of chemical deposition is allowed by provision of an atmospheric isolation barrier which prevents atmospheric oxygen from reaching the submerged gravel pack. Low oxygen levels both inhibit growth of iron-fixing aerobic bacteria, and slow development of chemical precipitates within the gravel pack and in native formations. A gravel pack efficiency sensor can be operated in conjunction with the atmospheric isolation barrier to advise a well operator when the gravel pack has become clogged with chemical or biological precipitates and the water pumping efficiency of the well has been reduced to a level requiring replacement of the gravel pack.

A ground water pumping assembly 21 in accordance with the present invention is illustrated in FIG. 1. A well bore 23 extends downward into groundwater-bearing native formations 20. Groundwater recovered by the pumping assembly 21 from the well bore 23 flows out through pipe 46 at the surface. The well bore 23 is partially lined with an impervious casing 27, permanently positioned at the top of the well bore 23 to extend downward from the surface. The impervious casing 27 is fluid tight and rigid enough to hold native formations 20 in position, preventing collapse of the native formations 20 into the bore 23. Steel or plastic piping, concrete, or other materials known in the art can be used to form the impervious casing 27.

As illustrated in FIG. 1, a pump inlet pipe 40 is positioned to extend toward the bottom of the well bore 23. Groundwater is drawn into the pump inlet pipe 40 through an inlet 44 by pumping action of a removable water pump 42 forming a portion of pump assembly 21. To prevent the influx of particles such as silt, sand, or gravel through the inlet 44 and into the pump 42, a tubular screen 26 is positioned in well bore 23 to surround the inlet 44. The tubular screen 26 has a top end 50, a bottom end 52, and defines a screen cavity 54 therein which is placed in fluid communication with the pump inlet 44 of pump inlet pipe 40. The tubular screen 26 is maintained in fluid tight connection with the pump inlet pipe 40 by dual annular seals 55 and 57 provided between the pump inlet pipe 40 and the tubular screen 26. The seals 55 and 57 are arranged in vertically spaced-apart relation to each another. The dual annular seals 55 and 57 are constructed of metal rings permanently welded to the pump inlet pipe 40. The seals 55 and 57 are circumscribed with an annular groove into which an O-ring (generally formed from elastomeric, flexible, and watertight materials known in the art) can be fitted to enhance sealing effectiveness between the pump inlet pipe 40 and the tubular screen 26. This design allows the pump inlet pipe 40 to be withdrawn from sealing connection with the tubular screen 26 without disturbing the position of the screen 26 in the well bore 23.

The tubular screen 26 is formed to include a plurality of apertures 29 sized to prevent admission of particles over a predetermined size (generally sand-sized particles and larger). The apertures 29 permit passage of groundwater from gravel pack 24 through the tubular screen 26 and into the screen cavity 54 of tubular screen 26 so that the ground water can be sucked into the inlet 44 of the pump inlet pipe 40.

A gravel pack 24 is also provided in the bore 23 between the tubular screen 26 and the native formations 20. The gravel pack 24 consists of loose gravel usually sized to have intergravel pore diameters approximately equal to the pore diameters of native formation 20, although larger pore diameters are also possible. Groundwater travels from the native formation 20, and into the gravel pack 24 with substantially no changes in velocity due to restricted pore diameters within the ground pack 24 relative to pore diameters of native formations 20. However, as groundwater flowing in gravel pack 24 nears the tubular screen 26, velocity induced pressure changes in the vicinity of the small screen apertures 29 (sand sized and smaller) induce chemical precipitation and consequent formation of deposits in pore spaces of the gravel pack 24. With time, the gravel pack 24 can become completely clogged with deposits.

As shown in FIG. 1, a gravel pack isolation barrier is provided to isolate the gravel pack 24 from the atmosphere to prevent or slow development of chemical precipitates and other deposits in the gravel pack 24. The well-clogging deposits which develop in gravel packs used in groundwater wells are known to develop at a more rapid pace in the presence of oxygen.

The pump assembly 21 includes a gravel pack pressure sensor unit 30 configured to measure the magnitude of pressure within the tubular screen 26 to determine the extent to which the gravel pack 24 and the apertures 29 in the tubular screen 26 are clogged with chemical precipitates. A pressure gauge 31 is positioned at the surface and visible to an operator. The pressure gauge 31 is operably connected by a pressure line 33 to a pressure sensor 35 and set to report the pressure level inside the tubular screen 26. Once the negative pressure rises above a threshold level, the pump operator would know that the gravel pack 24 or tubular screen 26 are clogged with precipitates and regeneration/replacement is required.

The pressure sensor 35 of the pressure sensing unit 30 is positioned below a sealing unit 60. The sealing unit 60 includes a valve 64 for introduction of pressurized gas (not shown) into a gas line 62 and elastic seal 28. When fully inflated as seen in FIG. 1, the elastic seal 28 is positioned between the top end 50 of the screen 26 and the impervious casing 27 to provide a fluid tight seal. By opening the valve 64, it is possible to deflate the elastic seal 28 for easy removal of the pump inlet pipe 40 from the bore 23, as shown in FIG. 2.

Sealing unit 60 prevents introduction of oxygen from the atmosphere through the well bore 23 into the gravel pack 24, greatly reducing the growth of aerobic bacteria known to promote biologic incrustations and iron reduction and deposition in a gravel pack. Another advantage of annular seal 28 is the creation of negative pressure in the gravel pack 24 during operation of pump assembly 21. This effectively enhances suction of groundwater into the gravel pack 24 from the native formation 20.

When replacement of the gravel pack 24 is indicated, according to the embodiment of the present invention illustrated in FIG. 1, a slide tube 38 is downwardly driven into the well bore 23. The slide tube 38 is sized to have an outer diameter smaller than the inner diameter of the impervious casing 27 to allow its easy insertion into the well bore 23. The slide tube 38 is typically constructed of rigid piping, and has enough structural strength to withstand driving impact downward into the bore 23. Once fully inserted into the well bore (as seen in FIG. 3) the slide tube 38 must have enough strength to hold native formations 20 in position, preventing collapse of the native formations 20 into the bore 23. Steel or engineering grade plastic piping, or other materials known in the art can be used to form the slide tube 38.

In operation, a driver 39 is attached to the slide tube 38 to promote its downward insertion into well bore 23. Conventional hammer, impact, hydraulic or other drivers known in the art can be used to downwardly drive the slide tube 38 into the well bore 23. As shown in FIG. 3, when the slide tube 38 is driven into place between the gravel pack 24 and the native formation 20, the pump inlet pipe 40 can be removed from the well bore 23, followed by removal of the clogged gravel pack 24. Suction bailers, graspers, bucket mechanisms, or other art recognized devices (not shown) can be used to retrieve the deposit incrusted gravel pack 24. The tubular screen 26 and pump inlet pipe 40 can then be replaced in their normal operating position at the bottom of the well bore 23, and a fresh gravel pack added to surround the screen 26, before the slide tube 38 is withdrawn from the bore 23.

Another embodiment that effectively reduces the accumulation of chemical deposits in accordance with the present invention is illustrated in FIGS. 4–6. A well bore 123 extends downward into groundwater-bearing native formations 120. Referring to FIGS. 4–5, the well bore 123 is lined with a porous casing 122 positioned at the bottom of the well bore 123 to hold back collapse of the groundwater-bearing native formations 120 into the bore 123. An impervious casing 127 is positioned above the porous casing 122. The impervious casing 127 is similar in design and construction to impervious casing 27 illustrated in FIGS. 1-3, and similarly acts to hold native formations 120 in position, permanently keeping open the upper portion of the well bore 123.

The porous casing 122 is best shown in FIG. 4. The casing 122 is constructed to have a plurality of pores 125 dimensioned to present substantially no impedance to the flow of groundwater moving from the native formation 120 into the bore 123. In addition to permitting free flow of groundwater through its pores 125, the porous casing 122 must have sufficient structural rigidity to prevent the infall of debris from the surrounding formations 120 into the well bore 123.

In preferred embodiments, the porous casing 122 is formed to included pores having a circular, square, rectangular, hexagonal, or other conventional shapes. The pores 125 are generally sized to have a diameter between about 5 millimeters to about 50 millimeters. Typically, the average diameter will range from about 10 to about 20 millimeters, the exact size being selected according to the size of gravel or rock debris in the native formations 120. The pore size must be selected to have a small enough diameter to prevent infall of gravel through the pores into the well bore 123. Rigid meshing, screening, pipes with a plurality of pores drilled therethrough, or other porous supports known in the art can be permanently installed at the bottom of the well bore 123.

Advantageously, such a large pore diameter porous casing 122 will not function to increase the velocity of groundwater flowing from the native formations into the gravel pack through the porous casing 122. Thus, the porous casing 122 will not itself promote chemical deposition in the native formations 120 surrounding the porous casing 122. Instead, chemical deposits or incrustations will develop, if at all, in the easily removed or regenerated gravel pack 124 inside porous casing 122.

The porous casing 122 is positioned in the well hole 123 to form a groundwater permeable barrier between the native formation 120 and a gravel pack 124 into the well hole 123. The porous casing 122 advantageously provides means for maintaining the drilled well bore 123 during regeneration of the well. Specifically, in regeneration of the well to improve pumping rates, it is contemplated that a work crew would remove a gravel pack 124 from well bore 123 and clean or replace it. Then, the cleaned or replaced gravel pack can be loaded back into the well bore 123 in the space maintained open and free of debris by porous casing 122.

As best shown in FIG. 5, a pump assembly 121 (substantially corresponding to pump assembly 21 of FIG. 1) for pumping groundwater from native formations 120 is provided. Like pump assembly 21, the pump assembly 121 includes a pump inlet pipe 140 connected to a pump 142. A tubular screen 126 is positioned in well bore 123 to surround the inlet 144. The tubular screen 126 has a top end 150, a bottom end 152, and defines a screen cavity 154 therein which is placed in fluid communication with the pump inlet 144 of pump inlet pipe 140.

In exactly the same manner as previously described in connection with annular seals 55 and 57 illustrated in FIG. 1, the tubular screen 126 is maintained in fluid tight connection with the pump inlet pipe 140 by annular seals 155 and 157 provided between the pipe 140 and the screen 126. The tubular screen 126 is formed to include a plurality of apertures 129.

A gravel pack 124 is also provided in the bore 123 between the tubular screen 126 and the porous casing 122, as shown best in FIGS. 5 and 6. The gravel pack 124 consists of loose gravel usually sized to have intergravel pore diameters approximately equal to the pore diameters of native formation 120, although larger pore diameters are also possible. Referring to FIG. 6, groundwater travels (as indicated by arrows 132) from the native formation 120, through the large apertures formed in porous casing 122, and into the gravel pack 124 with substantially no changes in velocity due to restricted pore diameters relative to pore diameters of native formations. However, as the groundwater flowing in gravel pack 124 nears the tubular screen 126, velocity induced pressure changes in the vicinity of the screen apertures 129 induce chemical precipitation and consequent formation of deposits 185 (indicated by cross-hatching) in pore spaces of the gravel pack 124. With time, the gravel pack 124 can become completely clogged with deposits 185 and require replacement or regeneration.

Figure 7:
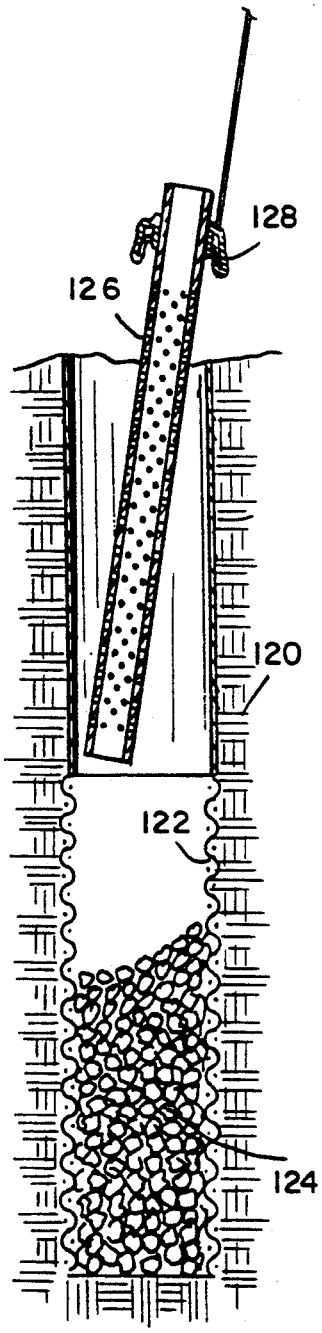
FIG. 7 is a view of the well shown in FIGS. 5 and 6 after deflation of an annular seal and removal of the pump assembly, but before removal of the gravel pack material.

In FIG. 7, the pump site is shown as it would look after removal of the pump assembly 121 but before removal of the gravel pack 124. The elastic seal 128 has been deflated to permit removal of tubular screen 126 from the well bore 123. The native gravel formation 120 is retained in place after removal of the pump assembly by porous casing 122 as shown in FIG. 6 to permit removal of the gravel pack 124 from the lower part of the well bore 123. The next step would involve removal of the gravel pack 124 by conventional methods and cleaning the pump assembly 121 prior to placing the cleaned pump assembly 121 back into the well bore 123. Cleaned or new gravel pack 124 is then placed to surround the tubular screen.

Although the invention has been described in detail with reference to certain preferred embodiments, variations and modifications exist within the scope and spirit of the invention as described and defined in the following claims.

What is claimed is:

1. An assembly for pumping groundwater from a bore of a well extending downward into groundwater bearing formations, the assembly comprising means for pumping groundwater including a pump inlet positioned in the bore of the well, a well casing extending into the bore of the well to prevent collapse of the well into the bore, means for screening the pump inlet to prevent intake of particles greater than a predetermined size, a gravel pack positioned in the bore of the well to surround the screening means, and distinct insertible means for barring collapse of native formations into the bore of the well following removal of the gravel pack.

2. The assembly of claim 1 wherein the barring means includes a slide tube reciprocally movable in the bore of the well, "and wherein" the slide tube is driven into the bore of the well and positioned in contact with groundwater bearing formation before removal of the gravel pack from the bore of the well.

3. The assembly of claim 2 wherein the slide tube is cylindrically configured.

4. The assembly of claim 1, wherein the gravel pack inserted between the screen and the well bore contains gravel sized to have intergravel pore diameters substantially equivalent to pore diameters of water-bearing formations contacting the gravel pack, allowing unimpeded flow of groundwater from the water-bearing formations into the gravel pack.

5. The assembly of claim 1, wherein the screening means comprises a tube having a top and a bottom end, the tube being formed to define a tube cavity accessible through a plurality of apertures defined in the tube, the apertures being sized to prevent uptake into the tube cavity of sand particles.

6. The apparatus of claim 5, wherein the pump inlet is positioned within the tube cavity adjacent to the top end of the tube.

7. The assembly of claim 1, wherein the wall casing comprises impervious casing extending downward into the bore of the well to prevent infall of debris, and means for sealing the bore between the pump inlet and the impervious casing to prevent fluid communication between an upper portion of the bore above the sealing means and lower portion of the bore below the sealing means.

8. The assembly of claim 7 wherein the sealing means comprises an inflatable elastic seal, the elastic seal inflatable with gas to expand and seal the bore, and deflatable by release of gas to break the seal.

9. The apparatus of claim 8, further comprising means for measuring fluid pressure in the region of the bore below the elastic seal.

10. A method for regenerating a well having a ground pack encrusted with chemical deposits, the method comprising the steps of inserting a slide tube into a well casing of the well to prevent infall of debris from native formations surrounding the bore of the well, withdrawing a pump assembly for pumping groundwater from a bore of a well, removing the gravel pack, replacing the gravel pack, and withdrawing the slide tube from the well casing of the well and replacing the pump assembly.

* * * * *